United States Patent [19]

Hendrischk et al.

[11] 4,354,766

[45] Oct. 19, 1982

[54] END-OF-PAPER SENSING DEVICE

[75] Inventors: Wolfgang Hendrischk, Neu-Ulm; Alexander Voigt, Gerstetten, both of Fed. Rep. of Germany

[73] Assignee: Mannesmann Aktiengesellschaft, Düsseldorf, Fed. Rep. of Germany

[21] Appl. No.: 199,624

[22] Filed: Oct. 22, 1980

[30] Foreign Application Priority Data

Oct. 23, 1979 [DE] Fed. Rep. of Germany ..... 2943241

[51] Int. Cl.[3] ..... B41J 29/42

[52] U.S. Cl. ..... 400/708; 400/616.1

[58] Field of Search ..... 400/708, 708.1, 708.2, 400/670, 670.1; 200/61.13; 226/11, 45; 335/189

[56] References Cited

U.S. PATENT DOCUMENTS

| | | | |
|---|---|---|---|
| 2,036,628 | 4/1936 | Grosvenor | 335/189 |
| 3,548,994 | 12/1970 | Hudson | 400/249 |
| 4,095,062 | 6/1978 | Savageau | 200/61.13 |

FOREIGN PATENT DOCUMENTS

| | | | |
|---|---|---|---|
| 2525263 | 10/1976 | Fed. Rep. of Germany | 400/708 |

*Primary Examiner*—Richard J. Apley
*Assistant Examiner*—David J. Isabella
*Attorney, Agent, or Firm*—Ralf H. Siegemund

[57] ABSTRACT

A one-arm sensing lever having a sensing cam and carrying a permanent magnet faces a spring-biased, two-arm rocking lever across the paper-feed path of a printer; in the absence of paper, the cam drops into the feed path and the magnet is now capable of attracting one arm of the rocking lever so that its other arm operates a switch.

5 Claims, 3 Drawing Figures

END-OF-PAPER SENSING DEVICE

BACKGROUND OF THE INVENTION

The present invention relates to an end-of-paper sensing device for a printer.

German printed Patent Application No. 25 25 263 discloses a sensing device which is actuated by the end of a sheet or web and directly causes a switching operation. Since spring bias is needed, the spring must be very finely tuned while, on the other hand, the load exerted by the feeler arm upon the paper is limited; the arm must not make imprints thereon. In practice, this kind of system is too sensitive to interferences such as vibrations which may cause incorrect responses.

It is an object of the present invention to provide a new and improved end-of-paper-responsive device which is less prone to errors, i.e., is of a more rugged construction without increasing the load of a feeler arm upon the paper.

DESCRIPTION OF THE INVENTION

In accordance with the preferred embodiment of the invention, it is suggested to provide a sensing lever having a cam and carrying a permanent magnet, both upstream on the paper-feed path; the cam is held by paper, but drops into the feed path after the trailing end of the paper sheet has passed, whereupon the magnet attracts one arm of a spring-biased, two-arm, lever-type switch bar whose other arm operates a switch. The invention, thus, decouples the sensing force of the sensing lever as effective on the paper, from the switching which is provided by the magnet. The invention uses the highly inhomogenic attraction field in front of such a magnet. Since attraction drops off drastically with increasing distance from a pole face, the magnet will be capable of attracting the one-switch bar arm only when fairly close to that arm; but the operating force then exerted upon the arm, particularly upon having completed the attraction, is significant and effective as a switch-operating force. Any spring bias in the device can, thus, be significantly stronger than in the prior art device so that the device is less sensitive to external interference. In conjunction therewith, the pivoting parts should be oriented to each other in such a way that the magnet, when attracting the one-switch bar arm, can make a flat surface-to-surface contact therewith, to maximize the effective attraction.

It is, therefore, an object of the present invention to provide a new and improved end-of-paper sensing device in which the sensing force and the output- and switching-action-generating forces are independent from each other.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Figure 1:
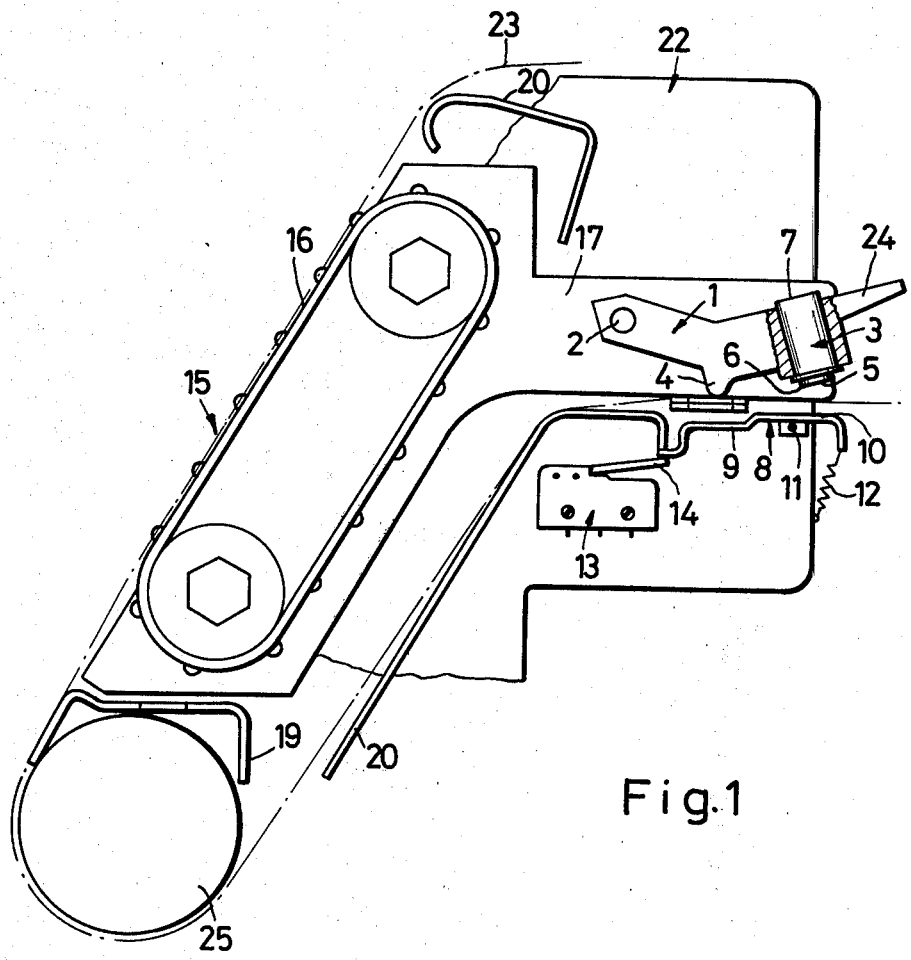
FIG. 1 is a section view of a portion of a printer in which an example of the preferred embodiment has been incorporated.

The end-of-paper sensing and control device depicted in the drawings is comprised, primarily, of a pivot arm or lever 1 carrying near its end a permanent magnet 3. This lever coacts with a switch bar 8 which, in a turn, operates a switch 13. These elements are disposed along a paper-feed path and, generally and in parts, face each other across that path. Lever 1 can be pivoted about a pivot point 2 and has a cam-like sensing element 4, normally resting on a sheet of paper 23 passing through the feed path (FIG. 1). The load element 4 exerted on the paper is given by the weight of the lever and that, in turn, is primarily determined by magnet 3. It can readily be seen that this load can be predetermined by the spacings of cam 4 and magnet 3 from the pivot axis. That load merely requires a positive sensing disposition, but only a light one as far as any force exerted upon the paper is concerned. The lever 1, moreover, extends, from pivot 2, in upstream direction along the paper-feed path. The lever ends, so to speak, in a handle 24.

The switch bar 8 is constructed as a two-arm lever and is disposed on the other side of sheet or web 22. Bar 8 can be pivoted about a pivot shaft or pin 11 which extends parallel to pivot pin 2 of lever 1. Pivot 11 is situated upstream from cam 4 and pin 2 as far as the motion of web 23 is concerned. Switch bar 8 is biased by a spring 12, but can be actuated against the spring bias by the magnet or lever 1, when brought into proximity of bar 8.

The bar 8 is constructed as a two-arm rocking or swivel device. An inner part or arm 9 of bar 8, on one side of the rocking axis (pin 11), engages a switching device 14 of a switch 13. An outer part or arm 10 of the rocking bar 8 is connected to spring 12. That part 10 is generally situated on an arc along which magnet 3 moves upon pivoting lever 1.

A first pole face 5 of magnet 3 faces part 10 of rocking or swivel bar 8; a rear edge 6 of that pole face 5 is particularly located for directly facing axis 11; i.e., the latter is directly on an arc delineated by edge 6 upon pivoting of lever 1. This arrangement serves as a stop and limit for lever 1. It is, moreover, important for pole face 5 to have an acute angle to sheet 23 in order to attain the position shown in FIG. 2, in which pole face 5 is in surface-to-surface engagement with the top face of bar portion and arm 10.

The printer includes a sprocket and traction device 15 for advancing sheet 23. This device is mounted in a case 17 which contains also lever 1. Bar 8 is constructed as a long bar; i.e., it extends farther in the direction transverse to the plane of the drawings and is mounted (i.e., its pivot is mounted) in the sides of printer case 22. Switch 13 is also secured to one of these sides. This arrangement ensures that the traction and sprocket device 15 (and a companion one) can be adjusted to different sheet widths, without change in the effectiveness of the end-of-paper sensing device.

The traction device includes a sprocket belt 16 and guide sheets 19, 20, and 21. The drawing also shows a platen 25. The print head itself is not shown. FIG. 1, moreover, shows the disposition of the parts when paper is in the feed path; cam 4 rests on sheet 23, the magnet 3 is relatively far from bar arm 10, and spring 12 has pulled that arm down so that the other bar arm, 9, does not activate switch arm 14 of switch 13.

Figure 2:
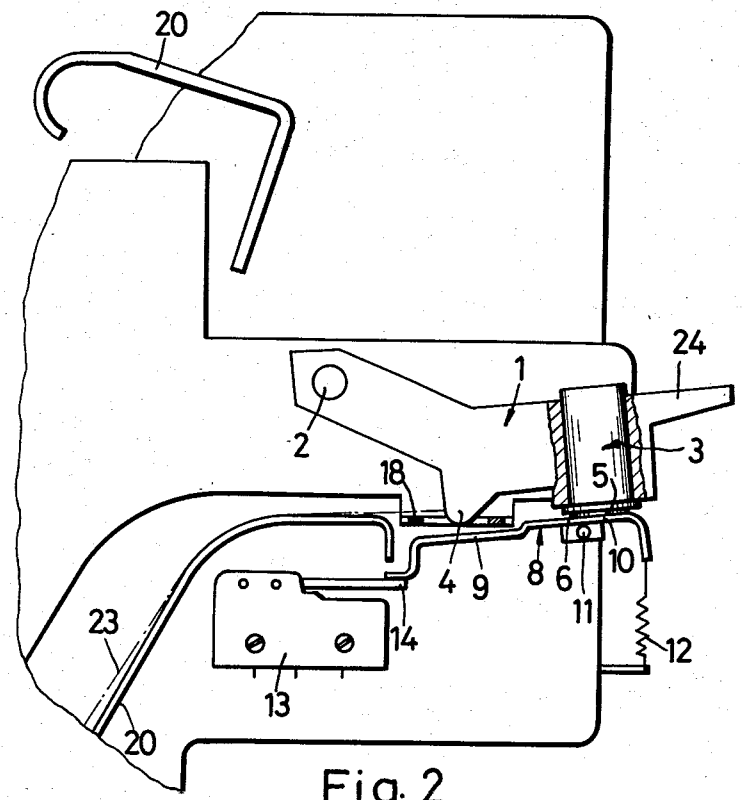
FIG. 2 is an enlarged detail of that portion of FIG. 1, shown in a disposition of response to the end of a sheet of paper.

FIG. 2 shows, in particular, that a paper support 18 is provided adjacent to cam 4; the support sheet 18 has an opening so that cam 4 can be inserted. FIG. 2 shows further that the end of paper 23 has just cleared the opening so that cam 4 drops. As long as paper is present, it covers the opening and prevents cam 4 from dropping into the opening.

As cam 4 drops, magnet 3 approaches rocking arm 10 of switch bar 8 and attracts that arm. Bar 8 will, thus, pivot counterclockwise so that rocking and switch bar arm 9 is lowered. This, in turn, presses switch arm 14 down for actuating switch 13. The switch is, thus, operated by the magnetic attraction force provided by magnet 3.

Figure 3:
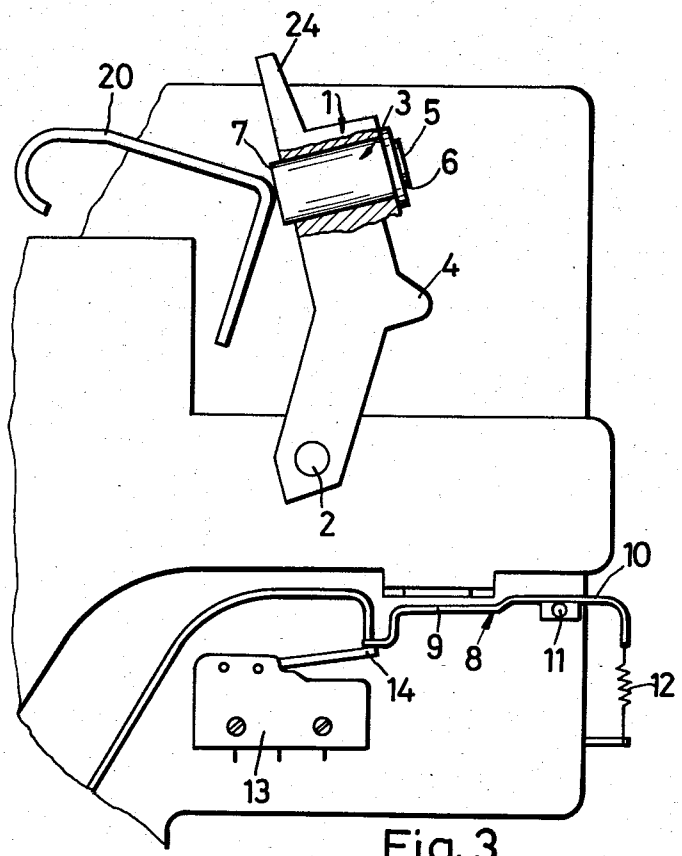
FIG. 3 shows the same detail as FIG. 2, but with an uplifted sensing lever.

As a new sheet of paper is fed into the printer, lever 1 is lifted by its handle 24 into the off position of FIG. 3. This requires that the attraction force of the magnet be overcome. In a prototype, this force has amounted to approximately 20 newtons. The lever 1 is held in the retracted position of FIG. 3 via the rear pole 7 which holds the magnet and the lever against the iron guide sheet 20. Sheet 20 does not have to be made of iron, but could be made of steel, or any other material which permits magnetic attraction; the same is true for switch bar 8, or at least for arm portion 10 thereof.

The invention is not limited to the embodiments described above; but all changes and modifications thereof, not constituting departures from the spirit and scope of the invention, are intended to be included.

We claim:

1. End-of-paper sensing device for a printer, there being a feed path for paper to be printed upon, comprising:

a pivot lever, having a pivot adjacent to the feed path and being capable of assuming a position for extending in upstream direction on the feed path;

a sensing cam on the lever disposed thereon to rest on the paper when in the feed path, but projecting into the path in the absence of such paper;

a permanent magnet mounted on the pivot lever;

a switch bar constructed as a two-arm rocking lever and being disposed adjacent to the feed path so that one arm faces said lever across the feed path, the paper when in the feed path is disposed between the switch bar and the lever, the bar being made of a material permitting attraction by the magnet, said bar further disposed so that said one arm is being attracted by and toward the magnet when the lever has pivoted the cam into the feed path and the magnet toward the bar and there is no paper between the magnet and the switch bar; and switch means disposed for being actuated by a second arm of said switch bar as the one arm is attracted toward the magnet.

2. Device as in claim 1, said permanent magnet being disposed so that its magnetic axis moves essentially along an arc upon pivoting, toward and away from said one arm.

3. Device as in claim 2, said magnet being disposed so that an arc described by an edge of one of its pole faces, the edge being near a pivot point of the pivot lever, facting said one arm, runs through a pivot axis of said switch bar, said pole face and said one arm being constructed and oriented so that upon attraction said pole face is in face-to-face contact with said one arm.

4. Device as in claim 1, including a magnetizable means against which a rear face of said magnet can abut for being retained thereby, upon pivoting said lever away from said feed path for facilitating feeding paper into the feed path.

5. Device as in claims 1 or 2, the cam being situated closer to the pivot of the lever than the magnet.

* * * * *